US011065496B2

(12) United States Patent
Leipheimer

(10) Patent No.: US 11,065,496 B2
(45) Date of Patent: Jul. 20, 2021

(54) HIGH-LOW PULLEY RACK SYSTEM FOR WEIGHT MACHINE

(71) Applicant: Specialty Fitness Systems, LLC, Franklin, PA (US)

(72) Inventor: Jerry K. Leipheimer, Sharpsville, PA (US)

(73) Assignee: Specialty Fitness Systems, LLC, Franklin, PA (US)

( * ) Notice: Subject to any disclaimer, the term of this patent is extended or adjusted under 35 U.S.C. 154(b) by 50 days.

(21) Appl. No.: 16/344,098

(22) PCT Filed: Nov. 13, 2017

(86) PCT No.: PCT/US2017/061228
§ 371 (c)(1),
(2) Date: Apr. 23, 2019

(87) PCT Pub. No.: WO2018/093699
PCT Pub. Date: May 24, 2018

(65) Prior Publication Data

US 2019/0240525 A1 Aug. 8, 2019

Related U.S. Application Data

(60) Provisional application No. 62/422,350, filed on Nov. 15, 2016.

(51) Int. Cl.
*A63B 21/062* (2006.01)
*A63B 21/00* (2006.01)
(Continued)

(52) U.S. Cl.
CPC .... *A63B 21/0624* (2015.10); *A63B 21/00065* (2013.01); *A63B 21/0628* (2015.10);
(Continued)

(58) Field of Classification Search
CPC ..... A63B 21/00058; A63B 21/00061; A63B 21/00065; A63B 21/00069;
(Continued)

(56) References Cited

U.S. PATENT DOCUMENTS 2,977,120 A * 3/1961 Morris ..... A63B 21/06 482/103
4,402,504 A * 9/1983 Christian ..... A63B 21/06 482/103
(Continued)

FOREIGN PATENT DOCUMENTS

CN 104225876 A 12/2014
CN 205323086 U 6/2016
(Continued)

*Primary Examiner* — Gary D Urbiel Goldner
(74) *Attorney, Agent, or Firm* — The Webb Law Firm

(57) ABSTRACT

A pulley rack for an exercise machine includes a support frame, an upright extending generally vertically within the support frame, a counterweight having one or more counterweight pulleys, the counterweight moveable in a vertical direction relative to the support frame, one or more guide pulleys mounted to the support frame, a cable end assembly mounted to the upright, and a pull cable having a fixed attachment end connected to the cable end assembly and a pullable end freely passing through the cable end assembly. The pull cable is routed through the cable end assembly, the counterweight pulleys, and guide pulleys such that a force exerted on the pullable end raises the counterweight. A section of the pull cable extends from the pullable end through the cable end assembly and downwardly to one of the guide pulleys mounted below the cable end assembly.

20 Claims, 12 Drawing Sheets

(51) Int. Cl.
*A63B 21/078* (2006.01)
*A63B 23/035* (2006.01)
*A63B 21/075* (2006.01)
*A63B 21/072* (2006.01)

(52) U.S. Cl.
CPC ..... *A63B 21/0632* (2015.10); *A63B 21/075* (2013.01); *A63B 21/078* (2013.01); *A63B 21/0724* (2013.01); *A63B 21/0783* (2015.10); *A63B 21/156* (2013.01); *A63B 21/4029* (2015.10); *A63B 23/03566* (2013.01); *A63B 2225/09* (2013.01); *A63B 2225/102* (2013.01)

(58) Field of Classification Search
CPC ..... A63B 21/00076; A63B 21/062; A63B 21/0622; A63B 21/0624; A63B 21/0626; A63B 21/0628; A63B 21/063; A63B 21/0632; A63B 21/072; A63B 21/0724; A63B 21/075; A63B 21/078; A63B 21/0783; A63B 21/08; A63B 21/15; A63B 21/151; A63B 21/152; A63B 21/154; A63B 21/156; A63B 21/159; A63B 21/4027; A63B 21/4029; A63B 21/4033; A63B 21/4035; A63B 21/4045; A63B 21/4047; A63B 21/4049; A63B 23/035; A63B 23/03508; A63B 23/03516; A63B 23/03525; A63B 23/03533; A63B 23/03541; A63B 23/0355; A63B 23/03558; A63B 23/03566; A63B 23/04; A63B 23/0405; A63B 23/0482; A63B 23/0494; A63B 23/12; A63B 23/1209; A63B 23/1218; A63B 23/1227; A63B 23/1236; A63B 23/1245; A63B 23/1281; A63B 2023/0411; A63B 2225/09; A63B 2225/093; A63B 2225/10; A63B 2225/102; A63B 2244/09
See application file for complete search history.

(56) References Cited

U.S. PATENT DOCUMENTS 4,598,908 A * 7/1986 Morgan ..... A63B 21/0724 482/104
4,603,855 A * 8/1986 Sebelle ..... A63B 21/06 482/103
4,784,384 A * 11/1988 Deola ..... A63B 21/063 482/138
4,856,773 A * 8/1989 Deola ..... A63B 21/063 482/102
4,907,798 A * 3/1990 Burchatz ..... A63B 21/06 482/104
5,725,459 A 3/1998 Rexach
6,447,430 B1 9/2002 Webb et al.
6,527,683 B2 * 3/2003 Tolles ..... A63B 21/152 482/103
7,070,546 B1 * 7/2006 Grasso ..... A63B 21/072 482/103
7,553,264 B2 6/2009 Carter
7,651,443 B1 * 1/2010 Fenster ..... A63B 23/03541 482/37
7,654,942 B1 * 2/2010 Batca ..... A63B 23/12 482/99
8,172,733 B1 * 5/2012 Batca ..... A63B 21/156 482/99
8,834,328 B1 * 9/2014 Batca ..... A63B 21/0628 482/99
9,302,139 B2 * 4/2016 Habing ..... A63B 21/4035
9,314,659 B2 * 4/2016 Gvoich ..... A63B 21/062
9,802,075 B2 * 10/2017 Gvoich ..... A63B 21/154
9,968,819 B2 * 5/2018 Hockridge ..... A63B 21/0628
2003/0060345 A1 3/2003 Piane, Jr.
2005/0032612 A1 * 2/2005 Keiser ..... A63B 21/0087 482/93
2006/0252609 A1 * 11/2006 Abelbeck ..... A63B 21/078 482/92
2007/0037674 A1 * 2/2007 Finn ..... A63B 21/156 482/97
2007/0054785 A1 * 3/2007 Drechsler ..... A63B 21/078 482/94
2007/0161472 A1 * 7/2007 Drechsler ..... A63B 21/4045 482/100
2013/0035220 A1 * 2/2013 Adams ..... A63B 21/156 482/129
2013/0065737 A1 * 3/2013 Habing ..... A63B 21/156 482/102
2013/0184128 A1 7/2013 Towley, III et al.
2013/0190143 A1 * 7/2013 Greenhill ..... A63B 21/0058 482/104
2013/0196832 A1 * 8/2013 Adams ..... A63B 21/151 482/129
2013/0274075 A1 * 10/2013 Habing ..... A63B 21/078 482/102
2013/0296144 A1 * 11/2013 Gvoich ..... A63B 21/4043 482/102
2014/0038777 A1 * 2/2014 Bird ..... A63B 21/151 482/5
2014/0121071 A1 5/2014 Strom et al.
2014/0228175 A1 * 8/2014 Lemos ..... A63B 71/0054 482/5
2014/0342878 A1 * 11/2014 Hashish ..... A63B 21/0058 482/8
2016/0250514 A1 9/2016 Gvoich
2017/0282002 A1 * 10/2017 Lee ..... A63B 71/0619
2018/0318635 A1 * 11/2018 Lee ..... A63B 21/0724
2019/0240525 A1 * 8/2019 Leipheimer ..... A63B 21/075
2019/0336812 A1 * 11/2019 Leipheimer ..... A63B 23/03525
2020/0155889 A1 * 5/2020 Leipheimer ..... A63B 21/00069

FOREIGN PATENT DOCUMENTS

DE 4442892 A1 6/1996
KR 20140045763 A * 4/2014 ..... A63B 23/1209
WO 2018089624 A1 5/2018

* cited by examiner

HIGH-LOW PULLEY RACK SYSTEM FOR WEIGHT MACHINE

CROSS-REFERENCE TO RELATED APPLICATIONS

This application is the United Sates national phase of International Application No. PCT/US2017/061228 filed Nov. 13, 2017, and claims priority to United States Provisional Patent Application No. 62/422,350 filed Nov. 15, 2016, the disclosures of which are hereby incorporated by reference in their entirety.

BACKGROUND OF THE INVENTION

Field of the Invention

This disclosure relates generally to exercise or weight machines and, more particularly, to an adjustable pulley rack system that allows a user to vary the location of a pull cable for performing exercises on a cable exercise machine.

Description of Related Art

Exercise machines which employ a cable and pulley system attached to a counterweight are well known. Conventionally, cable exercise machines include a support frame to which a moveable counterweight and one or more pulley are mounted. A cable extends vertically from the top of the counterweight and is routed through the one or more pulleys to a free end of the cable. Various attachments, such as D-handles, barbells, or rope handles, may be attached to the free end of the cable.

Resistance training exercises are performed by pulling on the attachment in order to lift the counterweight against the force of gravity. Often, the counterweight is adjustable to allow the user to select the amount of resistance provided.

One of the benefits of cable exercise machines is that they permit a variety of different exercise to be performed, because resistance is provided no matter the direction the user pulls the cable. Thus, cable exercise machines reduce the need for multiple exercise machines which are dedicated to providing resistance in a single direction or useful only for a limited number of exercise motions.

An additional feature of some cable exercise machines is that the attachment point from which the user pulls the cable is moveable along the support frame, so that the exercise machine has greater versatility. For example, the user may move the attachment point to a low position for exercises which require resistance in a downward direction, such a biceps curls or chest flyes. The user may move the attachment point to a high position for exercises which require resistance in an upward direction, such as pulldowns.

However, existing cable exercise machines are limited in that additional components necessary to perform certain exercises, such as bar catches needed for a barbell chess press, cannot be mounted to the cable exercise machine because the pull cable obstructs much of the support frame.

There exists a need for a cable exercise machine which provides the functionality of a moveable attachment point, while allowing other components to be attached to the support fame without obstructing or being obstructed by the pull cable.

SUMMARY OF THE INVENTION

In view of the foregoing, a need exists for an adjustable pulley rack which is compatible with other components of an exercise machine.

According to an aspect of the disclosure, a pulley rack for an exercise machine includes a support frame, an upright extending generally vertically within the support frame, a counterweight having one or more counterweight pulleys, the counterweight moveable in a vertical direction relative to the support frame, one or more guide pulleys mounted to the support frame, a cable end assembly mounted to the upright, and a pull cable having a fixed attachment end connected to the cable end assembly and a pullable end freely passing through the cable end assembly. The pull cable is routed through the cable end assembly, the counterweight pulleys, and guide pulleys such that a force exerted on the pullable end raises the counterweight. A section of the pull cable extends from the pullable end through the cable end assembly and downwardly to one of the guide pulleys mounted below the cable end assembly According to another non-limiting aspect of the disclosure, the cable end assembly is vertically slideable along the upright.

According to another non-limiting aspect of the disclosure, the cable end assembly is lockable in a plurality of positions along the upright.

According to another non-limiting aspect of the disclosure, the cable end assembly is lockable in any of a plurality of holes in the upright.

According to another non-limiting aspect of the disclosure, the cable end assembly includes a pivot pin permitting rotation of at least a portion of the cable end assembly about an axis parallel to the upright.

According to another non-limiting aspect of the disclosure, the pulley rack further includes a bar catch mounted to the upright and adapted to support a barbell at a predetermined height.

According to another non-limiting aspect of the disclosure, the pulley rack further includes a safety spotter arm mounted to the upright above the cable end assembly and adapted to prevent the barbell from dropping below a second predetermined height.

According to another non-limiting aspect of the disclosure, the cable end assembly is mounted to the upright at a bottom location of the upright, the barbell rests on the bar catch mounted above the cable end assembly, and the pullable end of the pull cable is affixed to the barbell such that force exerted vertically on the barbell raises the counterweight.

According to another non-limiting aspect of the disclosure, the pull cable is routed through one of the guide pulleys between a first of the counterweight pulleys and a second of the counterweight pulleys.

According to other aspects of the disclosure, a pulley rack for an exercise machine includes a support frame, a counterweight having one or more counterweight pulleys, the counterweight moveable in a vertical direction relative to the support frame, one or more guide pulleys mounted to the support frame, a cable end assembly moveably mounted to the upright, a first cable section extending from a fixed connection at the cable end assembly to a first of the counterweight pulleys, and a second cable section extending downwardly from a pullable connection at the cable end assembly around one of the guide pulleys and to the first of the counterweight pulleys. The counterweight is vertically moveable by a force exerted on the pullable connection of the second cable section. Movement of the cable end assembly along the upright does not move the counterweight.

According to another non-limiting aspect of the disclosure, wherein the first cable section extends upwardly from the fixed connection to one of the guide pulleys.

According to another non-limiting aspect of the disclosure, the first cable section extends around a second of the counterweight pulleys between the cable end assembly and the first of the counterweight pulleys.

According to another non-limiting aspect of the disclosure, the first cable section extends around one of the guide pulleys between the first of the counterweight pulleys and the second of the counterweight pulleys.

According to another non-limiting aspect of the disclosure, the first cable section extends around one of the guide pulleys between the cable end assembly and the first of the counterweight pulleys.

According to another non-limiting aspect of the disclosure, the pulley rack further includes a bar catch mounted to the upright above the cable end assembly, the bar catch adapted to support a barbell at a predetermined height.

According to another non-limiting aspect of the disclosure, the pulley rack further includes a safety spotter arm mounted to the upright above the cable end assembly and adapted to prevent the barbell from dropping below a second predetermined height.

According to another non-limiting aspect of the disclosure, the first cable section and the second cable section define a continuous length of cable.

According to other aspects of the disclosure, a method of operating an exercise machine includes moving a cable end assembly along an upright of a support frame, wherein the cable end assembly has a fixed attachment to a first end of a pull cable, and wherein a second end of the pull cable is pullable through the cable end assembly, and locking the cable end assembly in one of a plurality of positions along the upright. The pull cable, between the first end and the second end, extends downwardly from the cable end assembly and is routed through one or more guide pulleys mounted to the exercise machine and one or more counterweight pulleys mounted to a moveable counterweight. Moving the cable end assembly along the upright does not alter the position of a counterweight.

According to another non-limiting aspect of the disclosure, the method further includes exerting a force on the second end of the pull cable to raise the counterweight, wherein the counterweight is raised regardless of the direction of the force exerted on the second end of the pull cable.

According to another non-limiting aspect of the disclosure, the method further includes attaching a barbell to the second end of the pull cable, the barbell adapted to rest on at least one bar catch mounted to the upright.

The invention is further defined by the following clauses:

Clause 1: A pulley rack for an exercise machine, the pulley rack comprising: a support frame; an upright extending generally vertically within the support frame; a counterweight having one or more counterweight pulleys, the counterweight moveable in a vertical direction relative to the support frame; one or more guide pulleys mounted to the support frame; a cable end assembly mounted to the upright; and a pull cable having a fixed attachment end assembly and a pullable end freely passing through the cable end assembly; wherein the pull cable is routed through the cable end assembly, the counterweight pulleys, and guide pulleys such that a force exerted on the pullable end raises the counterweight, and wherein a section of the pull cable extends from the pullable end through the cable end assembly and downwardly to one of the guide pulleys mounted below the cable end assembly.

Clause 2: The pulley rack of clause 1, wherein the cable end assembly is vertically slideable along the upright.

Clause 3: The pulley rack of clause 1 or 2, wherein the cable end assembly is lockable in a plurality of positions along the upright.

Clause 4: The pulley rack of any of clauses 1 to 3, wherein the cable end assembly is lockable in any of a plurality of holes in the upright.

Clause 5: The pulley rack of any of clauses 1 to 4, wherein the cable end assembly comprises a pivot pin permitting rotation of at least a portion of the cable end assembly about an axis parallel to the upright.

Clause 6: The pulley rack of any of clauses 1 to 5, further comprising a bar catch mounted to the upright above the cable end assembly, the bar catch adapted to support a barbell at a predetermined height.

Clause 7: The pulley rack of any of clauses 1 to 6, further comprising a safety spotter arm mounted to the upright above the cable end assembly, the safety spotter arm adapted to prevent the barbell from dropping below a second predetermined height.

Clause 8: The pulley rack of any of clauses 1 to 7, wherein the cable end assembly is mounted to the upright at a bottom location of the upright, wherein the barbell rests on the bar catch mounted above the cable end assembly, and wherein the pullable end of the pull cable is affixed to the barbell such that force exerted vertically on the barbell raises the counterweight.

Clause 9: The pulley rack of any of clauses 1 to 8, wherein the pull cable is routed through one of the guide pulleys between a first of the counterweight pulleys and a second of the counterweight pulleys.

Clause 10: A pulley rack for an exercise machine, the pulley rack comprising: a support frame; a counterweight having one or more counterweight pulleys, the counterweight moveable in a vertical direction relative to the support frame; one or more guide pulleys mounted to the support frame; a cable end assembly moveably mounted to the upright; a first cable section extending from a fixed connection at the cable end assembly to a first of the counterweight pulleys; and a second cable section extending downwardly from a pullable connection at the cable end assembly around one of the guide pulleys and to the first of the counterweight pulleys; wherein the counterweight is vertically moveable by a force exerted on the pullable connection of the second cable section; and wherein movement of the cable end assembly along the upright does not move the counterweight.

Clause 11: The pulley rack of clause 10, wherein the first cable section extends upwardly from the fixed connection to one of the guide pulleys.

Clause 12: The pulley rack of clause 10 or 11, wherein the first cable section extends around a second of the counterweight pulleys between the cable end assembly and the first of the counterweight pulleys.

Clause 13: The pulley rack of any of clauses 10 to 12, wherein the first cable section extends around one of the guide pulleys between the first of the counterweight pulleys and the second of the counterweight pulleys.

Clause 14: The pulley rack of any of clauses 10 to 13, wherein the first cable section extends around one of the guide pulleys between the cable end assembly and the first of the counterweight pulleys.

Clause 15: The pulley rack of any of clauses 10 to 14, further comprising a bar catch mounted to the upright above the cable end assembly, the bar catch adapted to support a barbell at a predetermined height.

Clause 16: The pulley rack of any of clauses 10 to 15, further comprising a safety spotter arm mounted to the upright above the cable end assembly, the safety spotter arm adapted to prevent the barbell from dropping below a second predetermined height.

Clause 17: The pulley rack of any of clauses 10 to 16, wherein the first cable section and the second cable section define a continuous length of cable.

Clause 18: A method of operating an exercise machine, comprising: moving a cable end assembly along an upright of a support frame, wherein the cable end assembly has a fixed attachment to a first end of a pull cable, and wherein a second end of the pull cable is pullable through the cable end assembly; and locking the cable end assembly in one of a plurality of positions along the upright; wherein the pull cable, between the first end and the second end, extends downwardly from the cable end assembly and is routed through one or more guide pulleys mounted to the exercise machine and one or more counterweight pulleys mounted to a moveable counterweight; and wherein moving the cable end assembly along the upright does not alter the position of a counterweight.

Clause 19: The method of clause 18, further comprising exerting a force on the second end of the pull cable to raise the counterweight, wherein the counterweight is raised regardless of the direction of the force exerted on the second end of the pull cable.

Clause 20: The method of clause 18 or 19, further comprising attaching a barbell to the second end of the pull cable, the barbell adapted to rest on at least one bar catch mounted to the upright.

These and other features and characteristics of the high-low pulley rack will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and the claims, the singular form of "a", "an", and "the" include plural referents unless the context clearly dictates otherwise.

DESCRIPTION OF THE INVENTION

For purposes of the description hereinafter, the terms "upper", "lower", "right", "left", "vertical", "horizontal", "top", "bottom", "lateral", "longitudinal", and derivatives thereof shall relate to the disclosure as it is oriented in the figures. However, it is to be understood that the disclosure may assume alternative variations and step sequences, except where expressly specified to the contrary. It is also to be understood that the specific devices and processes illustrated in the attached drawings, and described in the following specification, are simply exemplary aspects of the disclosure. Hence, specific dimensions and other physical characteristics related to the aspects disclosed herein are not to be considered as limiting.

The present disclosure relates generally to exercise or weight machines and, more particularly, to an adjustable high-low pulley rack that allows a user to vary the location of a pull cable for performing exercises on a cable exercise or weight machine. Certain aspects of the components of the exercise or weight machine and the high-low pulley rack system are illustrated in FIGS. 1-12.

Figure 1:
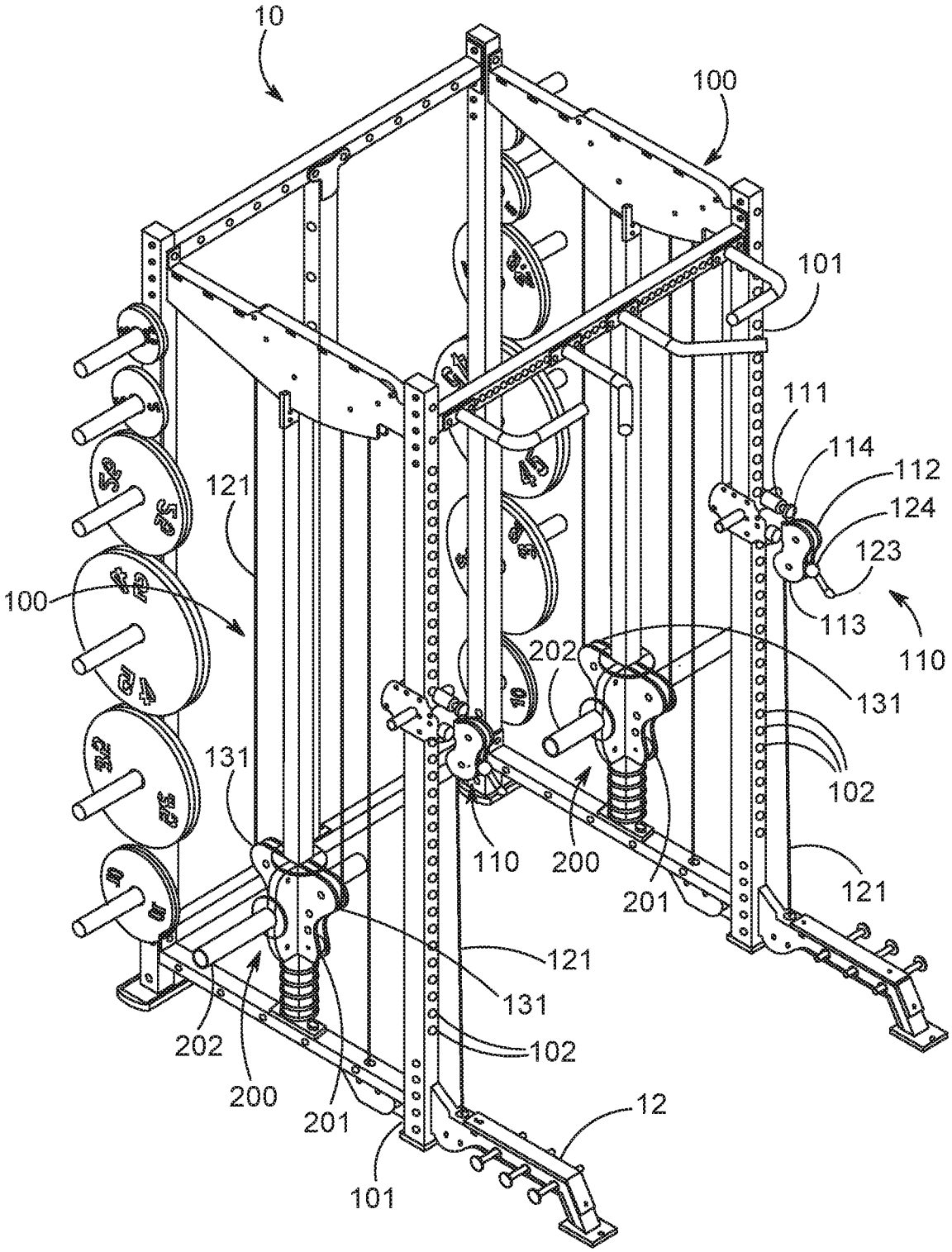
FIG. 1 is a perspective view of a cable exercise machine including a high-low pulley rack system.

Referring now to FIGS. 1-4, an exercise machine 10 including a high-low pulley rack 100 is shown. The exercise machine 10 includes a support frame 12 to which the counterweights 200 and the components of the high-low pulley rack 100 are attached. In particular, the high-low pulley rack 100 includes uprights 101, cable end assemblies 110, and pull cables 121. The exercise machine 10 as illustrated in FIG. 1 shows a pair of high-low pulley racks 100 arranged in tandem on the exercise machine 10. However, it is to be understood that in other aspects, a single high-low pulley rack 100 may be used.

Figure 2:
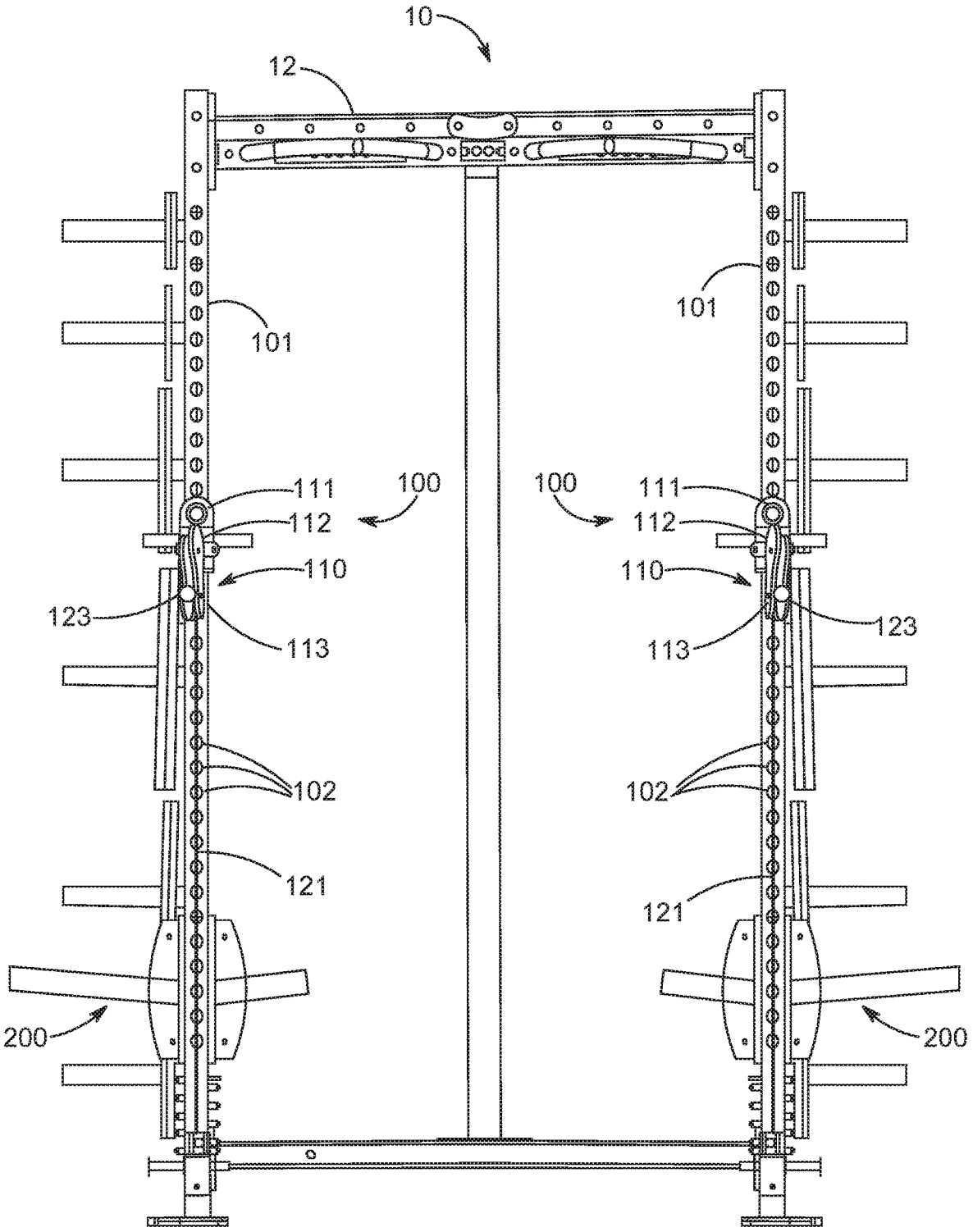
FIG. 2 is a front view the exercise machine of FIG. 1.

Referring now to FIG. 2, each upright 101 includes a plurality of indexing holes 102 spaced vertically along the upright 101. The plurality of index holes 102 cooperate with a popper pin 111 of the cable end assembly 110 to lock the cable end assembly 110 to the upright 101. The popper pin 111 of the cable end assembly 110 can be locked into any one of the plurality of index holes 102, permitting the user to position the cable end assembly 110 at a desired vertical position on the upright 101.

Figure 3:
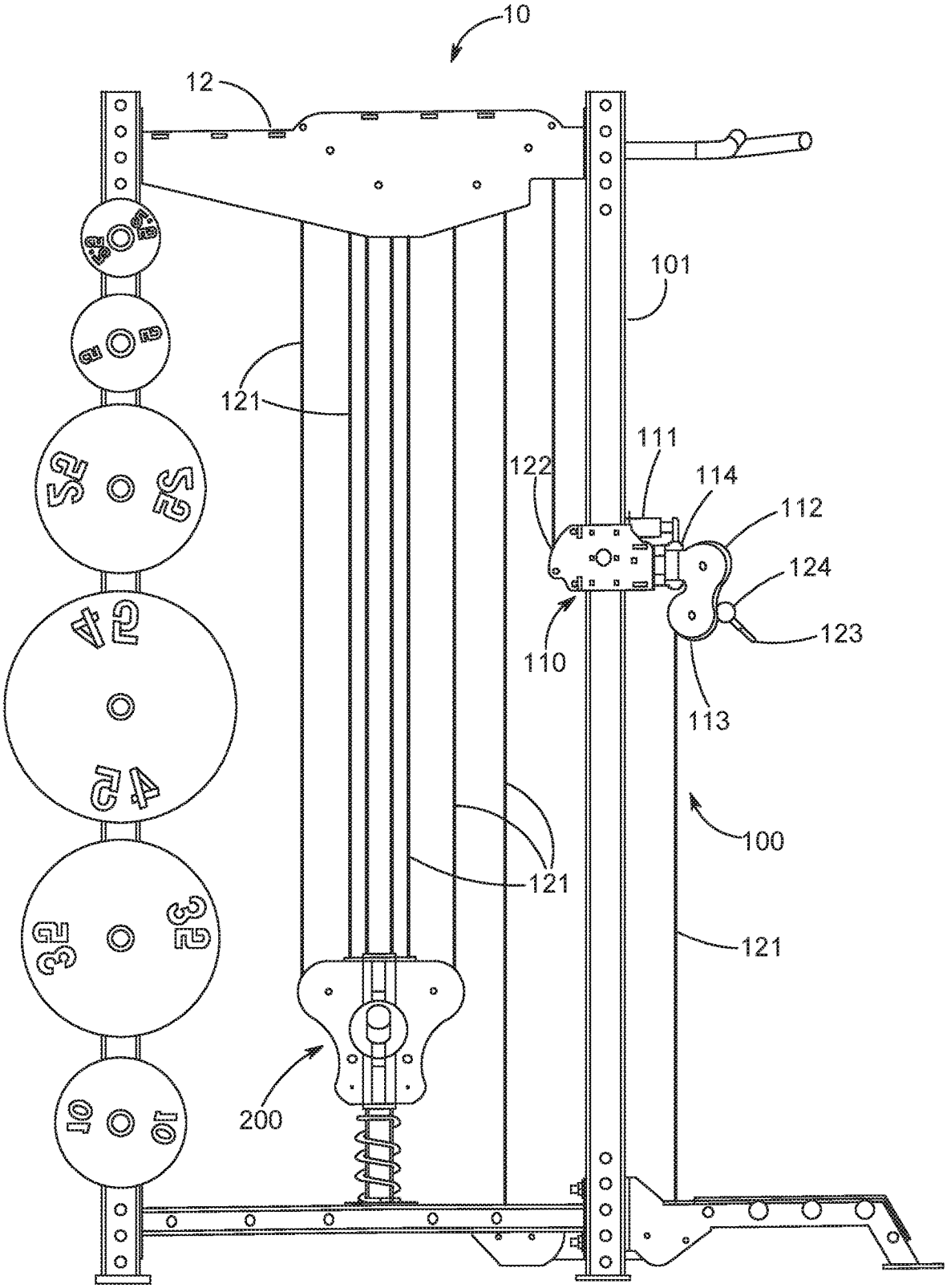
FIG. 3 is a side view the exercise machine of FIG. 1.
Figure 4:
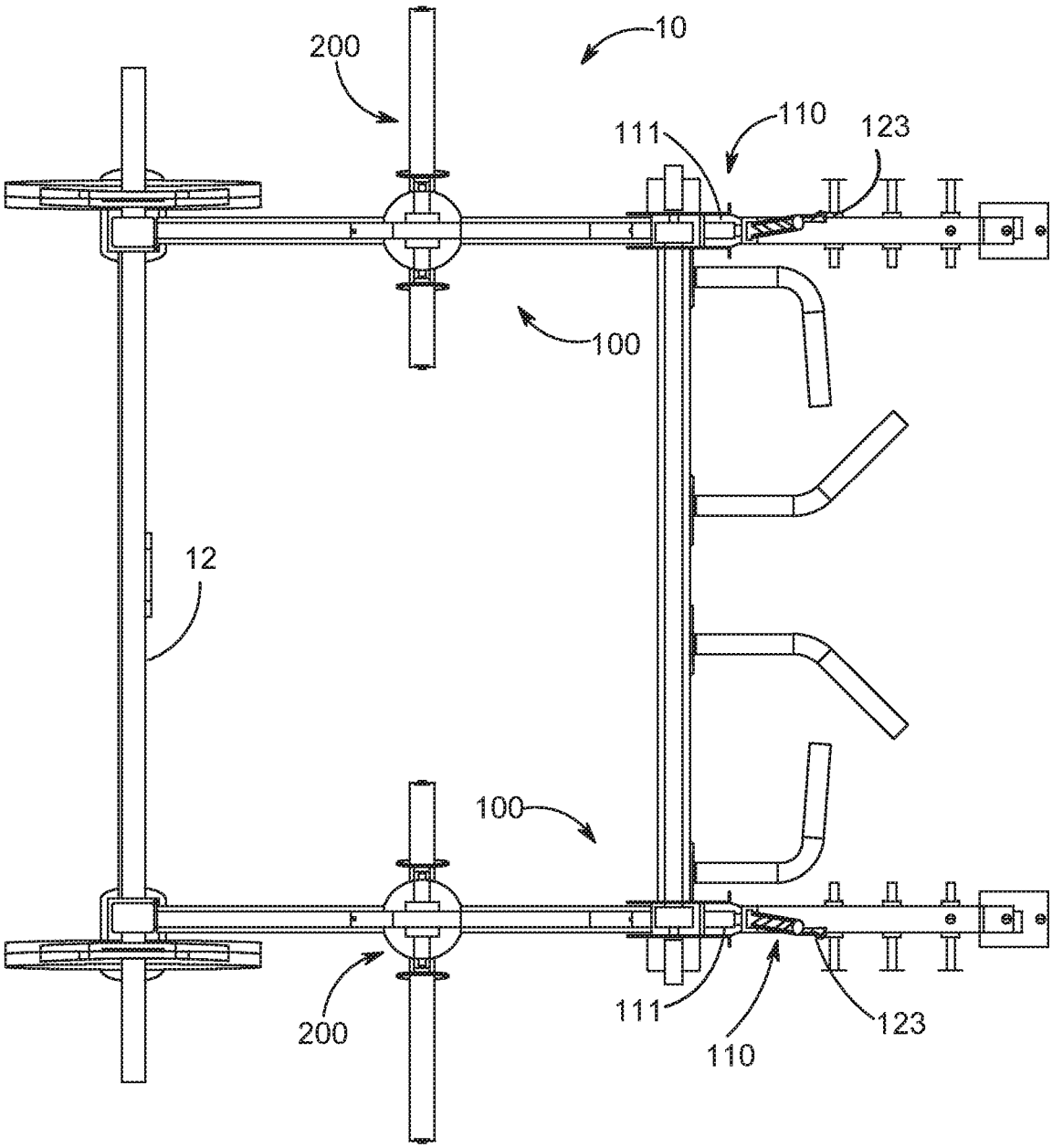
FIG. 4 is a top view the exercise machine of FIG. 1.

Referring now to FIG. 3, each cable end assembly 110 of the high-low pulley rack system 100 includes the popper pin 111, an upper end pulley 112, and a lower end pulley 113. The upper end pulley 112 and the lower end pulley 113 are arranged on opposing sides of the pull cable 121, such that the pull cable 121 is supported whether it is pulled downwardly or upwardly by a user. If the pull cable 121 is pulled downwardly by the user, the pull cable 121 at least partially engages the lower end pulley 113. Conversely, if the pull cable 121 is pulled upwardly, the pull cable 121 at least partially engages the upper end pulley 112. The cable end assembly 110 may include a pivot pin 114 which permits the upper end pulley 112 and the lower end pulley 113 to rotate about an axis parallel to the upright 101. In this manner, the upper end pulley 112 and the lower end pulley 113 may self-align horizontally in the direction which the pull cable 121 is pulled.

With continued reference to FIG. 3, a fixed end connection 122 of the pull cable 121 is attached to the cable end assembly 110. A pullable end 123 of the pull cable 121 freely passes through the cable end assembly 110 between the upper end pulley 112 and the lower end pulley 113. The pullable end 123 includes a retention device 124 which prevents the pullable end 123 from slipping backward through the upper end pulley 112 and the lower end pulley 113. The retention device 124 may be, for example, a ball encompassing a portion of the pull cable 121 which it too large to pass between the upper end pulley 112 and the lower end pulley 113.

Figure 5:
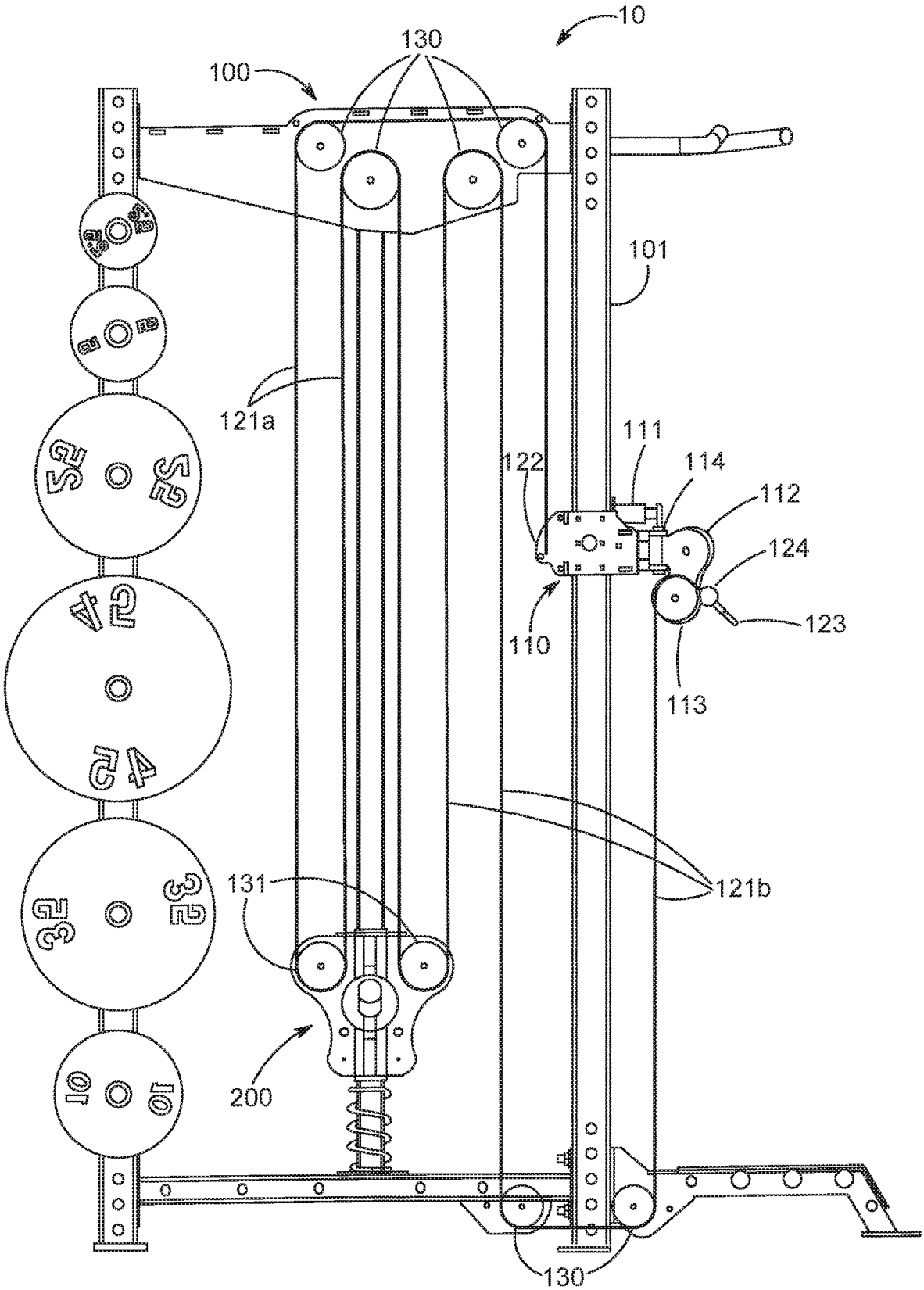
FIG. 5 is a cable schematic of the high-low pulley rack system.
Figure 6:
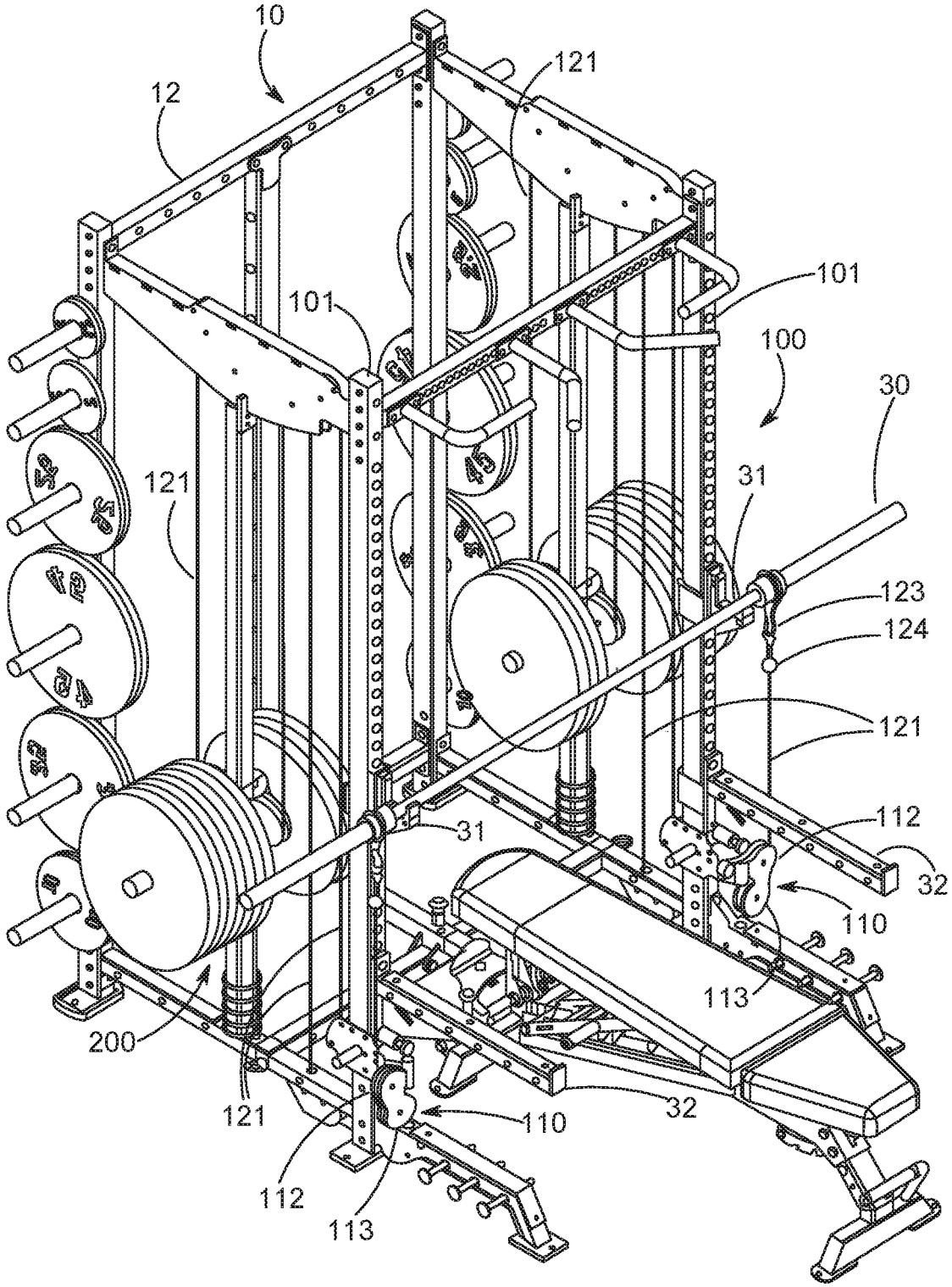
FIG. 6 is a perspective view of the cable exercise machine of FIG. 1 with a barbell and barbell hooks.
Figure 7:
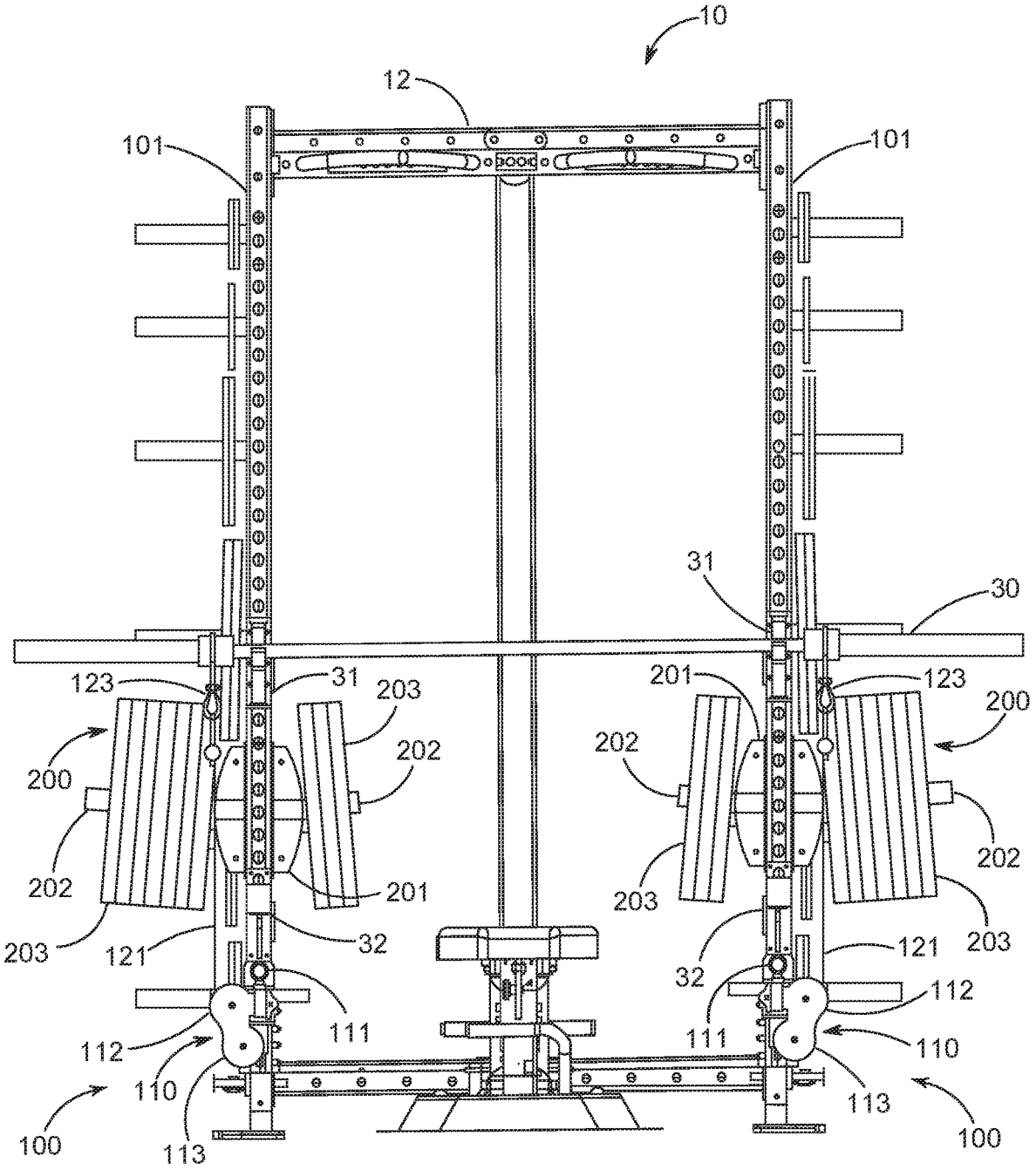
FIG. 7 is a front view the exercise machine of FIG. 6.
Figure 8:
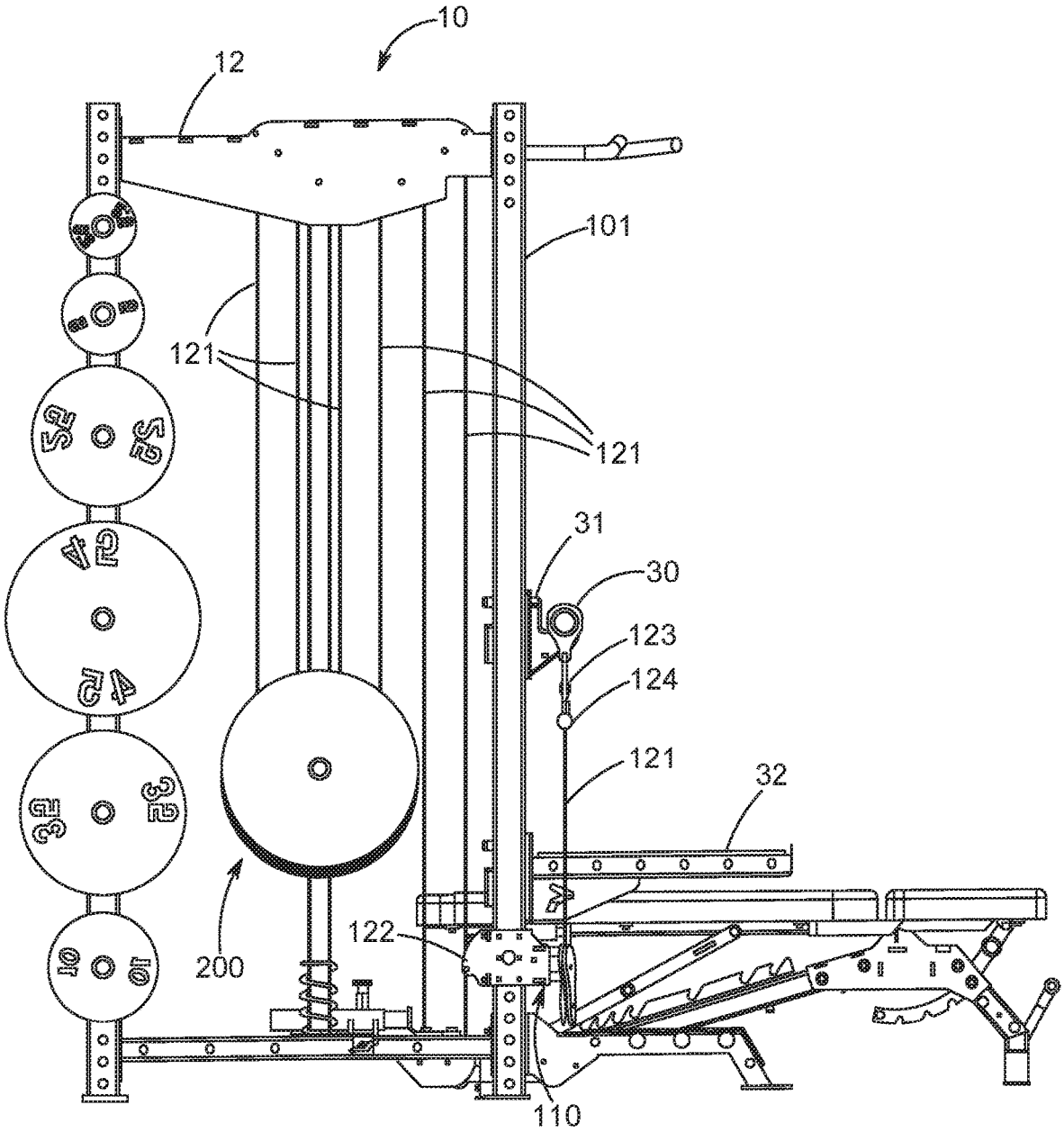
FIG. 8 is a side view the exercise machine of FIG. 6.
Figure 9:
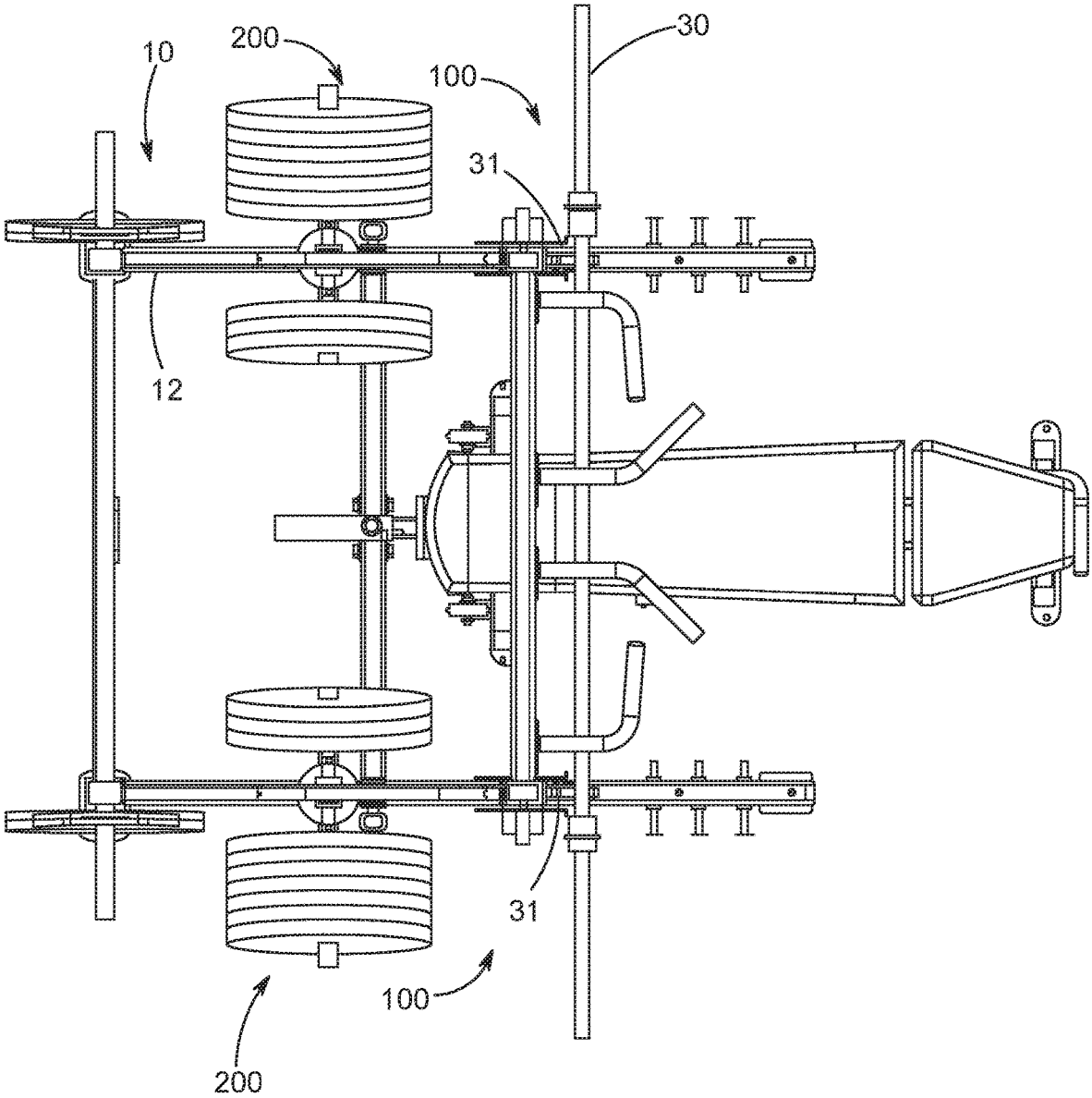
FIG. 9 is a top view the exercise machine of FIG. 6.

Referring now to FIG. 5, the pull cable 121 is routed from the fixed end connection 122, through the counterweight 200, and back to the pullable end 123 at the cable end assembly 110. More specifically, the pull cable 121 is routed through one or more guide pulleys 130 mounted to the support frame 12 of the exercise machine 10 and one or more counterweight pulley 131 mounted to the counterweight 200. Each of the guide pulleys 130 and counterweight pulleys 131 changes the direction of the pull cable 121. A first section 121*a* of the pull cable 121 extends from the fixed end connection 122 at the cable end assembly 110 to one of the counterweight pulleys 131, such that the weight of the counterweight 200 imparts tension to the pull cable 121. The first section 121*a* of the pull cable 121 may be routed around one or more of the guide pulleys 130 to provide additional guidance and stabilization to the first section 121*a*. A second section 121*b* of the pull cable 121 extends from one of the counterweight pulleys 131 to the pullable end 123 of the pull cable 121, such that the tension imparted on the pull cable 121 by the counterweight 200 induces the pullable end 123 of the pull cable 121 towards the cable end assembly 110. The second section 121*b* extends downwardly from the cable end assembly 110 such that other components of the exercise machine 10 may be mounted to the upright 101 above the cable end assembly 110 without obstructing or being obstructed by the second section 121*b*. The second section 121*b* of the pull cable 121 may be routed around one or more of the guide pulleys 130 to provide additional guidance and stabilization to the second section 121*b*.

With continued reference to FIG. 5, the cable routing arrangement of the pull cable 121 described above allows the cable end assembly 110 to be adjusted vertically along the upright 101 as desired by the user. When the popper pin 111 of the cable end assembly 110 is released and the cable end assembly 110 is moved up or down the upright 101, the pull cable 121 travels freely over the guide pulleys 130 and the counterweight pulleys 131 without moving the counterweight 200.

Figure 10:
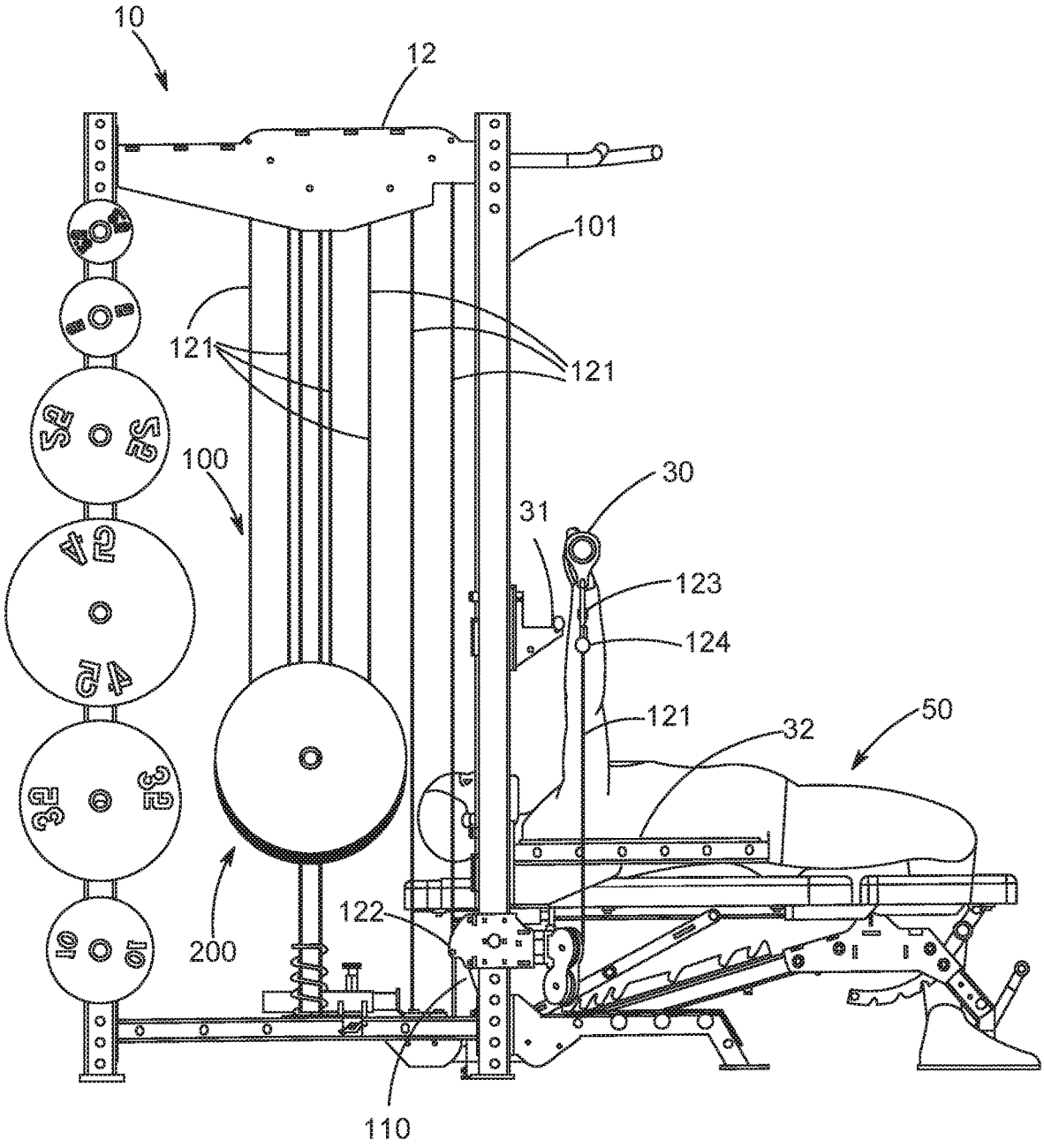
FIG. 10 is a side view of the exercise machine of FIG. 6 with a user performing a chest press exercise.

Referring now to FIG. 6-9, the exercise machine 10 is shown with the high-low pulley rack 100 is arranged for the user 50 to perform a chest press exercise. A barbell 30 is positioned on bar catches 31 mounted to the uprights 101. Additionally, safety spotter arms 32 are mounted to the uprights 101 below the bar catches 31. The cable end assemblies 110 are attached to the uprights 101 in a position below the bar catches 31 and safety spotter arms 32. The pullable ends 123 of the pull cables 121 are routed around the upper end pulley 112 of the cable end assemblies 110, and the pullable ends 123 are clipped to the barbell 30 such that pushing the barbell 30 upwards imparts tension to the pull cables 121. Referring now to FIG. 10, if sufficient force is exerted against the barbell 30 by the user 50, the force transmitted through the pull cables 121 raises the counterweight 200.

Figure 11:
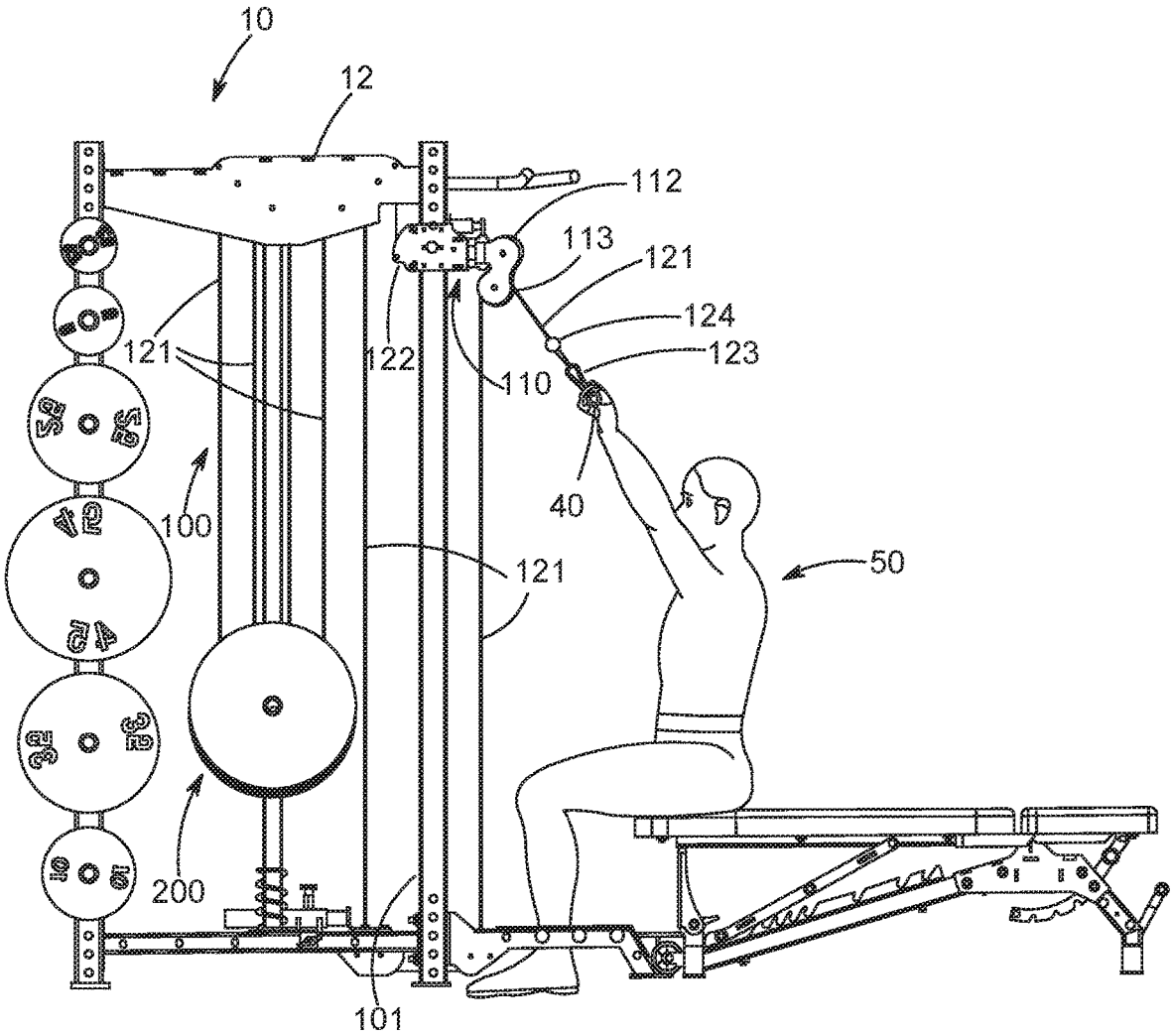
FIG. 11 is a side view of the cable exercise machine of FIG. 1 with the user performing a pulldown exercise.

Referring now to FIG. 11, the exercise machine 10 is shown with the high-low pulley rack system 100 is arranged for the user 50 to perform a pulldown exercise. The cable end assemblies 110 are attached to the uprights 101 in a position above the user 50, and a bar or other gripping device 40 is attached to the pullable ends 123 of the pull cables 121. The pullable ends 123 are routed around the lower end pulley 113 of the cable end assemblies 110, and the user 50 exerts downward force on the pull cables 121 to raise the counterweight 200.

Various embodiments of the counterweights 200 may be used with the high-low pulley rack 100. FIGS. 1-11 illustrate a trolley arrangement for the counterweight 200. Referring back to FIGS. 1 and 7, a trolley 201 houses the counterweight pulleys 131. The trolley slides up and down a guide of the support frame 12 as the pull cable 121 is pulled by the user 50. The trolley 201 may have one or more pegs 202 projecting generally outwardly such that standard weight-lifting plates 203 may be loaded onto the pegs 202.

Figure 12:
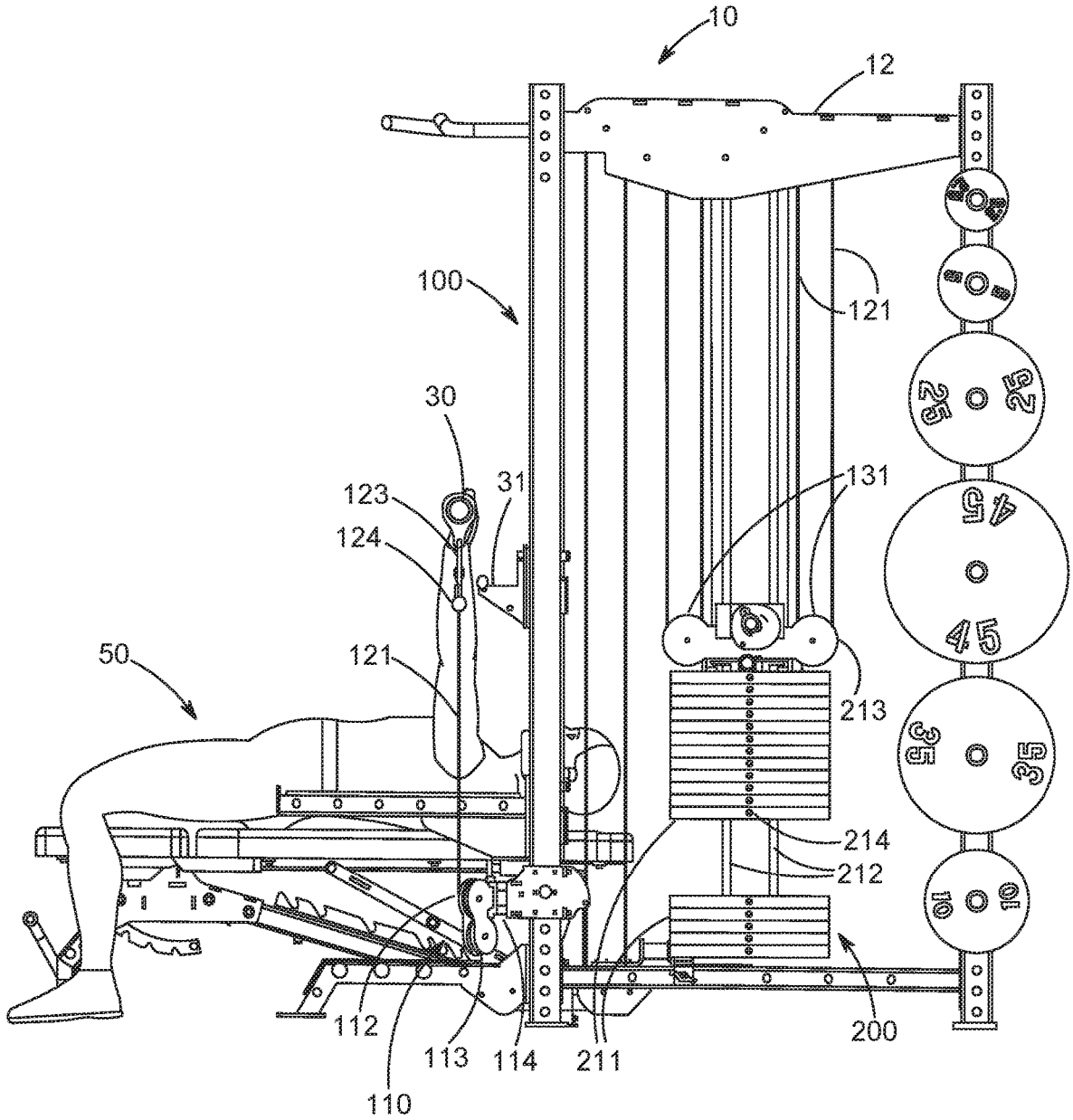
FIG. 12 is a side view of the exercise machine of FIG. 6 showing an alternative counterweight arrangement.

Alternatively, the counterweights 200 may be a weight stack arrangement, as shown in FIG. 12. The weight stack arrangement includes a plurality of plates 211 having axially aligned bores which slide along one or more guide shafts 212 connected to the support frame 12. A carrier 213 houses the counterweight pulleys 131. A pin 214 or other locking mechanism may be used to fix one or more of the plurality of plates 211 to the carrier 213. Thus, when the pull cable 121 is pulled, the carrier 213 and any plates 211 fixed to the carrier 213 provide resistance to the user 50.

While various aspects of the high-low pulley rack 100 were provided in the foregoing description, those skilled in the art may make modifications and alterations to these aspects without departing from the scope and spirit of the invention. For example, it is to be understood that this disclosure contemplates that, to the extent possible, one or more features of any aspect can be combined with one or more features of any other aspect. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A pulley rack for an exercise machine, the pulley rack comprising:

a support frame;

an upright extending generally vertically within the support frame;

a counterweight having one or more counterweight pulleys, the counterweight moveable in a vertical direction relative to the support frame;

one or more guide pulleys mounted to the support frame;

a cable end assembly mounted to the upright; and a pull cable having a fixed attachment end assembly and a pullable end freely passing through the cable end assembly;

wherein the pull cable is routed through the cable end assembly, the counterweight pulleys, and guide pulleys such that a force exerted on the pullable end raises the counterweight, wherein the fixed attachment end assembly of the pull cable is connected to the cable end assembly adjacent to a first vertical side of the upright, and wherein a section of the pull cable extends from the pullable end through the cable end assembly and downwardly to one of the guide pulleys mounted below the cable end assembly along a second vertical side of the upright.

2. The pulley rack of claim 1, wherein the cable end assembly is vertically slideable along the upright.

3. The pulley rack of claim 1, wherein the cable end assembly is lockable in a plurality of positions along the upright.

4. The pulley rack of claim 1, wherein the cable end assembly is lockable in any of a plurality of holes in the upright.

5. The pulley rack of claim 1, wherein the cable end assembly comprises a pivot pin permitting rotation of at least a portion of the cable end assembly about an axis parallel to the upright.

6. The pulley rack of claim 1, further comprising a bar catch mounted to the upright above the cable end assembly, the bar catch adapted to support a barbell at a predetermined height.

7. The pulley rack of claim 6, further comprising a safety spotter arm mounted to the upright above the cable end assembly, the safety spotter arm adapted to prevent the barbell from dropping below a second predetermined height.

8. The pulley rack of claim 6, wherein the cable end assembly is mounted to the upright at a bottom location of the upright, wherein the barbell rests on the bar catch mounted above the cable end assembly, and wherein the pullable end of the pull cable is affixed to the barbell such that force exerted vertically on the barbell raises the counterweight.

9. The pulley rack of claim 1, wherein the pull cable is routed through one of the guide pulleys between a first of the counterweight pulleys and a second of the counterweight pulleys.

10. A pulley rack for an exercise machine, the pulley rack comprising:

a support frame;

a counterweight having one or more counterweight pulleys, the counterweight moveable in a vertical direction relative to the support frame;

one or more guide pulleys mounted to the support frame;

a cable end assembly moveably mounted to an upright;

a first cable section extending from a fixed connection at the cable end assembly along a first vertical side of the upright to a first of the counterweight pulleys; and a second cable section extending downwardly from a pullable connection at the cable end assembly along a second vertical side of the upright around one of the guide pulleys and to the first of the counterweight pulleys;

wherein the counterweight is vertically moveable by a force exerted on the pullable connection of the second cable section; and wherein movement of the cable end assembly along the upright does not move the counterweight.

11. The pulley rack of claim 10, wherein the first cable section extends upwardly from the fixed connection to one of the guide pulleys.

12. The pulley rack of claim 10, wherein the first cable section extends around a second of the counterweight pulleys between the cable end assembly and the first of the counterweight pulleys.

13. The pulley rack of claim 12, wherein the first cable section extends around one of the guide pulleys between the first of the counterweight pulleys and the second of the counterweight pulleys.

14. The pulley rack of claim 10, wherein the first cable section extends around one of the guide pulleys between the cable end assembly and the first of the counterweight pulleys.

15. The pulley rack of claim 10, further comprising a bar catch mounted to the upright above the cable end assembly, the bar catch adapted to support a barbell at a predetermined height.

16. The pulley rack of claim 15, further comprising a safety spotter arm mounted to the upright above the cable end assembly, the safety spotter arm adapted to prevent the barbell from dropping below a second predetermined height.

17. The pulley rack of claim 10, wherein the first cable section and the second cable section define a continuous length of cable.

18. A method of operating an exercise machine, the method comprising:

moving a cable end assembly along an upright of a support frame, wherein the cable end assembly has a fixed attachment to a first end of a pull cable adjacent to a first vertical side of the upright, and wherein a second end of the pull cable is pullable through the cable end assembly; and locking the cable end assembly in one of a plurality of positions along the upright;

wherein the pull cable, between the first end and the second end, extends downwardly from the cable end assembly along a second vertical side of the upright and is routed through one or more guide pulleys mounted to the exercise machine and one or more counterweight pulleys mounted to a moveable counterweight; and wherein moving the cable end assembly along the upright does not alter the position of the moveable counterweight.

19. The method of claim 18, further comprising exerting a force on the second end of the pull cable to raise the moveable counterweight, wherein the moveable counterweight is raised regardless of the direction of the force exerted on the second end of the pull cable.

20. The method of claim 18, further comprising attaching a barbell to the second end of the pull cable, the barbell adapted to rest on at least one bar catch mounted to the upright.

* * * * *